US005657495A

United States Patent [19]

Dufresne

[11] Patent Number: 5,657,495

[45] Date of Patent: Aug. 19, 1997

[54] TRAP-FORMING DEVICE AND TOILET BOWL PROVIDED WITH SUCH A DEVICE

[76] Inventor: Guy Dufresne, 6bis Rue Gambetta, 37230 Luynes, France

[21] Appl. No.: 495,658

[22] PCT Filed: Jan. 27, 1994

[86] PCT No.: PCT/FR94/00102

§ 371 Date: Nov. 6, 1995

§ 102(e) Date: Nov. 6, 1995

[87] PCT Pub. No.: WO94/17256

PCT Pub. Date: Aug. 4, 1994

[30] Foreign Application Priority Data

Jan. 27, 1993 [FR] France ..... 93 00920

[51] Int. Cl.[6] ..... E03D 1/02

[52] U.S. Cl. ..... 4/434; 4/435

[58] Field of Search ..... 4/434, 435, 441, 4/420, 491

[56] References Cited

U.S. PATENT DOCUMENTS 3,482,267 12/1969 Liljendahl ..... 4/434
3,984,080 10/1976 Varis et al. ..... 251/5
4,357,719 11/1982 Badger et al. ..... 4/434

FOREIGN PATENT DOCUMENTS 15332 9/1881 Germany .
9202878 6/1992 Germany .
1063711 3/1967 United Kingdom .

*Primary Examiner*—David J. Walczak
*Attorney, Agent, or Firm*—Wolf, Greenfield & Sacks, P.C.

[57] ABSTRACT

A trap-forming device that includes a hollow body having an upstream orifice situated in a bottom portion of the body for communicating with an upstream length of fluid evacuation pipework, and a downstream orifice situated in the bottom portion of the body for communicating with a downstream length of the evacuation pipework. The device also includes a retainer defining an overflow edge and cooperating with a portion of the upstream length of pipework to retain a barrier-forming quantity of fluid, and a control displacement mechanism for displacing the retainer between an active position and retracted position. The trap-forming device may be connected to a toilet bowl.

8 Claims, 5 Drawing Sheets

TRAP-FORMING DEVICE AND TOILET BOWL PROVIDED WITH SUCH A DEVICE

The present invention relates to a trap-forming device intended, in particular, to be inserted between two lengths of pipework for evacuating waste water.

Such traps are known that comprise a body having an inlet orifice or upstream orifice that communicates with an upstream length of the pipework, and an outlet orifice or downstream orifice that communicates with a downstream length of the pipework.

Between the inlet orifice and the outlet orifice, such a known trap is constituted by a hollow body defining an upwardly-directed tubular portion followed by a downwardly-directed tubular portion that runs into the outlet orifice. At the junction between the two tubular portions, the body defines an overflow edge that is situated above the inlet orifice.

When a fluid flows through the body, the fluid must pass over the overflow edge in order to reach the outlet orifice.

Consequently, when the upstream length extends to a level which is situated above the overflow edge, as happens in pipework for evacuating waste water, a certain quantity of fluid is retained after the flow has stopped in the upwardly-directed tubular portion of the trap and in the upstream length situated beneath the level of the overflow edge.

In other words, the upwardly-directed tubular portion of the trap constitutes means for retaining a fluid barrier that serves to prevent bad smells that occur in the downstream length from being transmitted into the upstream length.

Clearly if the fluid barrier itself includes evil-smelling elements, then bad smells can propagate in the upstream length.

In order to avoid such a drawback, it is therefore necessary for the barrier to be constituted by clean fluid.

To this end, waste water is evacuated using a relatively large flow of clean water so that at the end of evacuation the fluid is constituted in practice solely by clean water.

At present, for ecological, climatological, and economic reasons, it is desirable to reduce consumption of clean water, and consequently, unnecessary consumption of clean water for evacuating waste water is becoming a major problem.

That is why attempts have been made over the last few years to reduce the quantity of water that is used to clean a toilet bowl provided with a trap.

Certain devices exist at present that make it possible to use only five liters of water where previously it was necessary to use seven or even eight liters of water.

Nevertheless, this quantity of water must suffice to clean the toilet bowl and the trap properly.

Cleaning is considered as being proper if it satisfies Standard NF-D-126201 which defines test methods and specifications for measuring suitability for use in toilet bowls.

That standard takes the following four criteria into consideration:

the effectiveness of evacuation;

the renewal of water in the trap;

the quality of wall rinsing; and splashing out from the bowl.

It turns out that when tests are performed with reduced quantities of cleaning water, the bowls tested do not comply with the standard because the criterion for trap water renewal is not satisfied.

In other words, the trap normally used with such bowls constitutes a critical point in reducing the quantity of water required for cleaning a toilet bowl.

Consequently, there exists a need for a trap in which renewal of the barrier-forming fluid is sufficient and which enables the quantity of water required for cleaning a toilet bowl to be reduced while still satisfying Standard NF-D-12-201.

An object of the present invention is therefore to provide a novel type of trap-forming device in which the renewal of water during waste water evacuation by means of a quantity of clean water is satisfactory and enables it to be used with a toilet bowl.

To this end, the present invention provides a trap-forming device having a hollow body including an upstream orifice situated in the bottom portion of the body and communicating with an upstream length of fluid evacuation pipework, retaining means defining an overflow edge and co-operating with a portion of the upstream length to retain a quantity of fluid that forms a fluid barrier at the end of evacuation, and a downstream orifice situated in a bottom portion of the body and communicating with a downstream length of evacuation pipework, the device being characterized in that the retaining means are displaceable between an active position and a retracted position, the device including controlled displacement means for controlling displacement of the retaining means between the two positions.

According to other characteristics:

in the retracted position of the retaining means, the flow of fluid is more or less rectilinear between the upstream orifice and the downstream orifice;

the retaining means are constituted by an elastically deformable membrane and the displacement means are means for deforming the membrane;

in the retracted position, the membrane is not deformed, and it extends longitudinally in the flow direction, its longitudinal direction as measured in the vicinity of the bottom of the body being greater than the diameter of the upstream orifice;

in a plane perpendicular to the flow direction, the membrane is U-shaped, with the ends of the branches of the U-shape being fixed to the body, the membrane including a U-shaped upstream edge which is fixed against a wall of the body that includes the upstream orifice, which orifice is situated inside the U-shape, the downstream edge of the membrane being free;

in the non-deformed, retracted position, the membrane includes a U-shaped downstream edge situated in a plane perpendicular to the flow direction and situated in the vicinity of the downstream orifice, the downstream orifice being situated facing the inside of the U-shape;

the deformation means comprise a rod rotatably mounted on the body about an axis perpendicular to the flow direction and situated beneath the membrane in the vicinity of the upstream orifice, the rod being situated, when in its rest position beneath the membrane and when not deforming the membrane, so as to extend substantially in a midplane of the membrane towards the downstream orifice, the deformation means including actuator means for actuating the rod and situated outside the body; and the actuator means are fixed on the shaft for rotating the rod and include a lever and return means urging the lever towards the active position of the membrane.

The present invention also provides a toilet bowl connected to a trap-forming device of the present invention.

The present invention will be better understood on reading the following detailed description given purely by way of example and made with reference to the accompanying drawings, in which:

FIG. 1 shows a trap-forming device 2 of the present invention.

Figure 1:
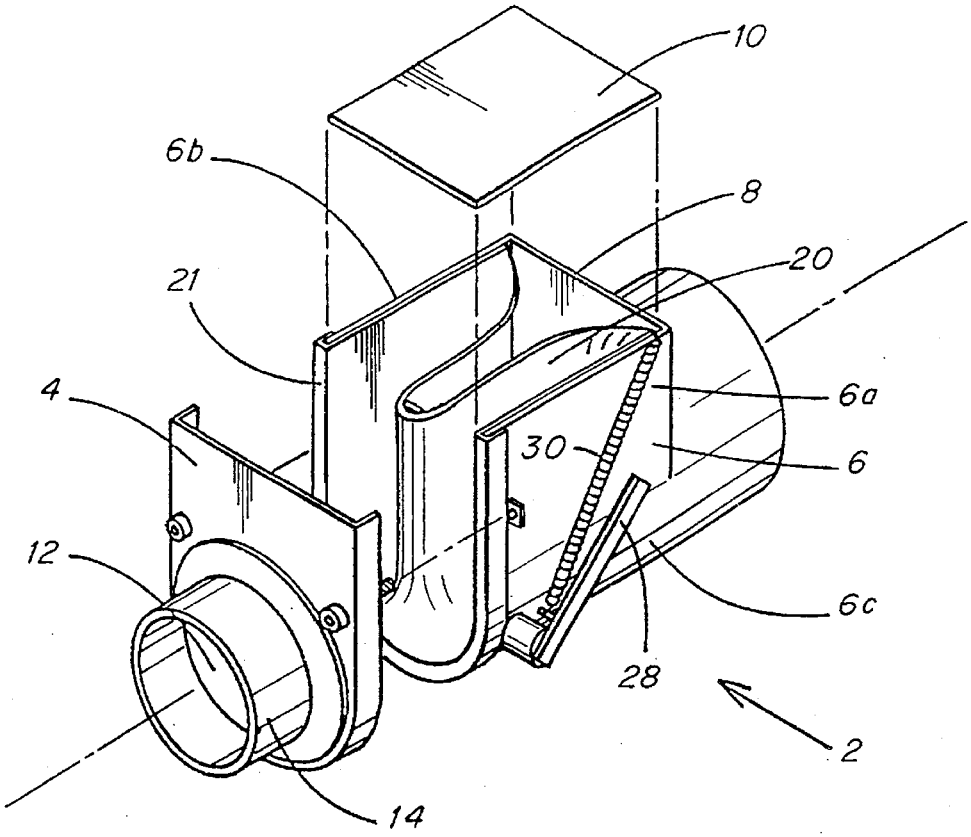
FIG. 1 is an exploded perspective view of a trap-forming device of the present invention, with the retaining means being in the active position.

The device 2 comprises a hollow body defined by a front wall 4, a longitudinal wall 6 of U-shaped cross-section defining two longitudinal walls 6*a* and 6*b*, and a rounded wall 6*c* defining the bottom of the U-shape. The body also includes a rear wall 8 and a cover 10.

The front wall 4 includes an inlet orifice or upstream orifice 12 provided with coupling-forming means 14 communicating with an upstream length of pipework (not shown).

The upstream orifice 12 is disposed in the bottom portion of the front wall 4.

Figure 2:
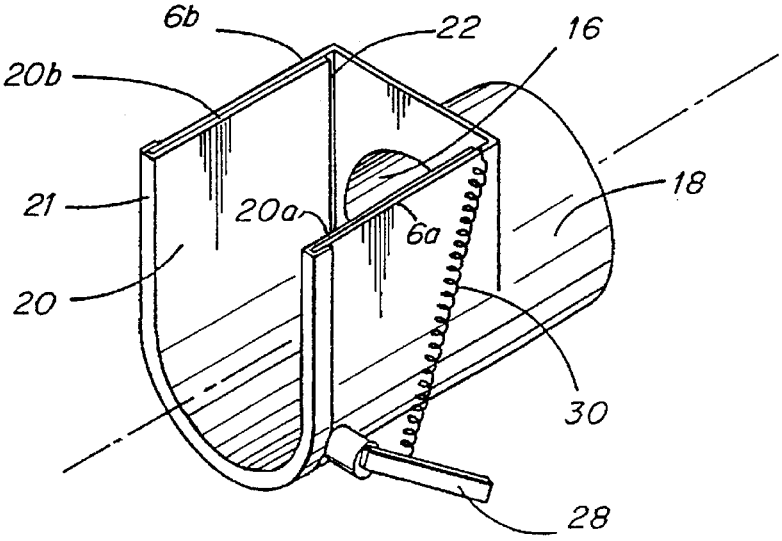
FIG. 2 is a perspective view analogous to FIG. 1, with certain elements omitted for reasons of clarity, the retaining means being in the retracted position.
Figure 5:
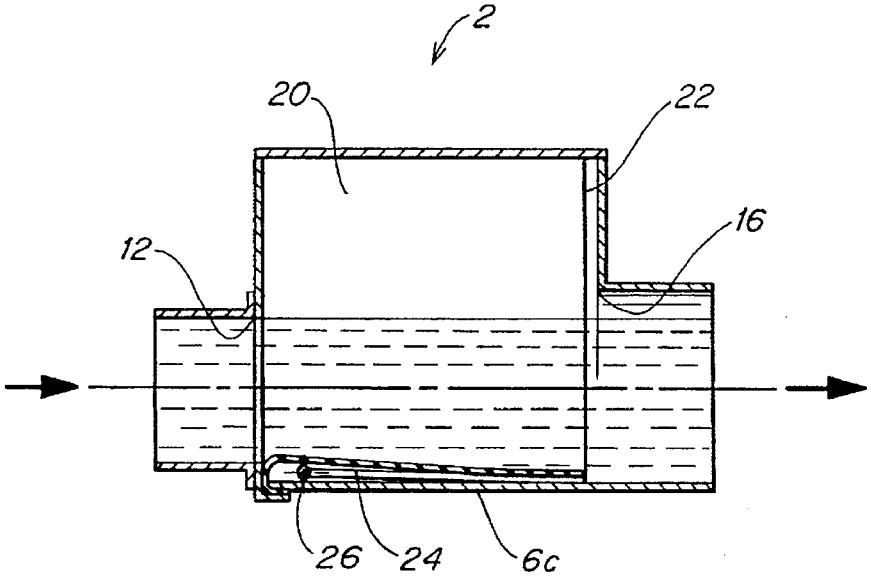
FIG. 5 is a longitudinal section view analogous to FIG. 3, with the retaining means being in the retracted position.

The rear wall 8 includes an outlet orifice or downstream orifice 16 situated in its bottom portion (see FIGS. 2 and 5). The downstream orifice 16 is provided with a coupling-forming element 18 communicating with a downstream length of evacuation pipework (not shown).

According to the present invention, the body 4 includes retaining means between the upstream orifice 12 and the downstream orifice 16, the retaining means being constituted by an elastically deformable membrane 20.

In the non-deformed state, the membrane 20 has a U-shaped cross-section extending along the longitudinal wall 6 of the body of the device 2.

The membrane 20 has two edges 20*a* and 20*b* at the free ends of the U-shape, which edges are fixed, e.g. by gluing, near the top portion of the wall 6, respectively in the vicinity of the upper edges of the walls 6*a* and 6*b*.

The membrane 20 includes an upstream edge 21 which is folded over the outside of the wall 6 of the body and which is fixed thereto by means of the front wall 4.

The membrane 20 also includes a downstream edge 22 (see FIGS. 2 and 5) having a U-shape and situated in a plane perpendicular to the flow direction and in the vicinity of the outlet orifice 16.

The distance between the upstream edge and the downstream edge as measured along the bottom of the U-shaped wall 6, when the membrane is not deformed, is shorter than the vertical size of the front wall 4 of the body of the device 2, but larger than the diameter of the inlet orifice 12.

It should be observed that the distance between the upstream edge and the downstream edge level with the edges 20*a* and 20*b* may be different from that measured level with the bottom of the U-shape, the downstream edge 22 then not being in a vertical plane.

The downstream orifice 16 is situated facing the inside of the U-shape formed by the membrane 20 when the membrane is in its non-deformed state (see FIG. 2).

Similarly, it should be observed that the inlet orifice or upstream orifice 12 is always situated inside the U-shape formed by the upstream edge of the membrane 20.

Consequently, when the membrane is in its retracted position, as can be seen in FIG. 5, flow through the device 2 of the invention takes place directly and in practically rectilinear manner from the inlet orifice 12 to the outlet orifice 16.

The body of the device 2 of the present invention also includes means for displacing the retaining means and constituted by deformation means for deforming the membrane 20.

The deformation means include a rod or blade 24 situated inside the body between the membrane 20 and the wall 6*c* forming the bottom of the body. The rod 24 is fixed to a shaft 26 that extends perpendicularly to the fluid flow direction.

The shaft 26 is mounted to rotate about its own axis via a bearing (not shown) disposed in a hole (not shown) in the wall 6*c*, and it includes an end that projects outside the body.

In a variant, the shaft 26 may have its opposite end mounted in another bearing organized in the hollow body of the device 2.

A lever is fixed on the end of the arm 26 that projects outside the body of the device 2, thereby constituting means for actuating the rod 24 by manual rotation of the shaft 26.

Figure 6:
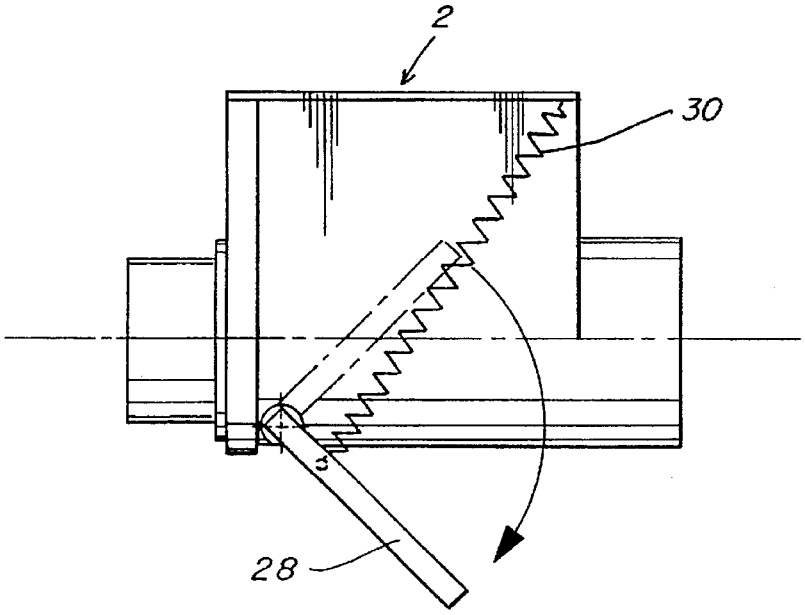
FIG. 6 is a side view of the trap-forming device of the present invention, showing the means for actuating the means for displacing the retaining means.

A spring 30 is organized between the lever 28 and an outside portion of the body of the device 2 so as to return the lever 28 towards the position in which the rod 24 deforms the membrane 20, which position is shown in chain-dashed lines in FIG. 6.

Figure 3:
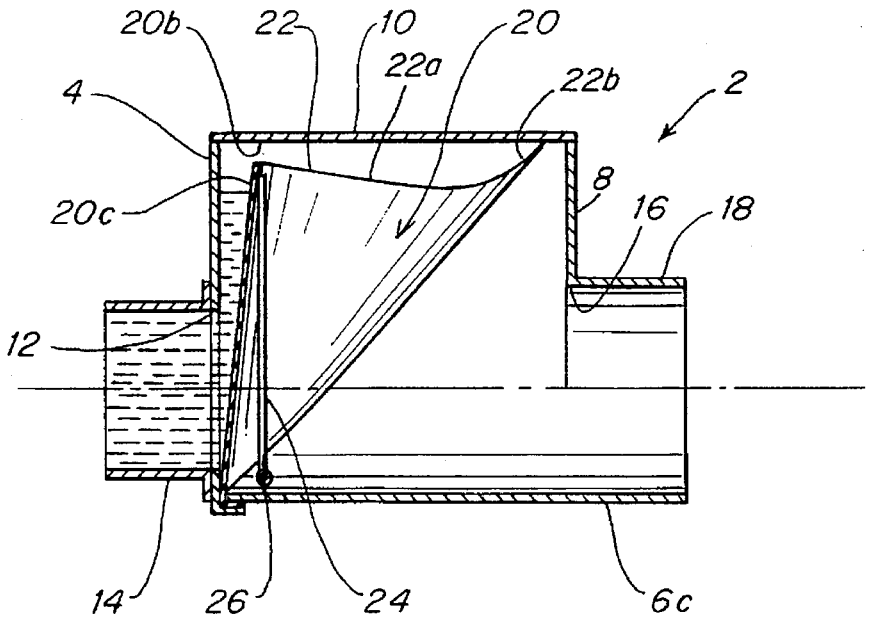
FIG. 3 is a longitudinal section view of the trap-forming device of FIG. 1.

In this position of the lever 28, the rod 24 extends perpendicularly to the axis of the upstream orifice 12, more or less parallel to the front wall 4, as shown in FIG. 3, thereby deforming the membrane 20.

Figure 4:
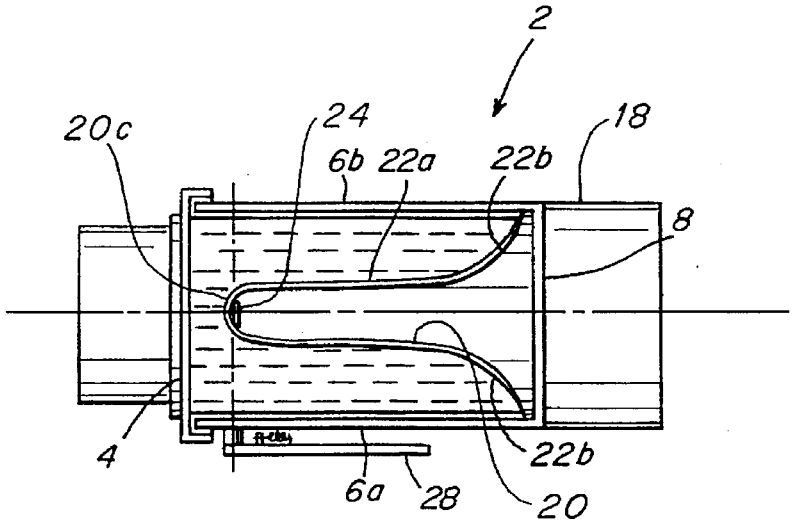
FIG. 4 is a plan view of the trap-forming device of FIG. 1, the top portion thereof being omitted.

When the rod 24 is in this particular position, the membrane 20 is deformed so as to have a fold 20*c* (see FIGS. 3 and 4) extending more or less in a vertical plane that includes the axis of the upstream orifice 12, the fold sloping slightly relative to the vertical.

The edge 22 of the membrane extends more or less in a horizontal plane which is situated above the inlet orifice because the length of the edges 20*a* and 20*b* of the membrane is greater than the diameter of the inlet orifice 12, with the edge 22 then constituting an overflow edge.

When the lever 28 is in the position shown by solid lines in FIG. 6, the rod 24 extends along the bottom of the U-shaped longitudinal wall 6 towards the downstream orifice 16, as shown in FIG. 5. The length of the rod 26 is shorter than the vertical size of the front wall 4 of the body of the device 2.

In such a position, the membrane 20 is not deformed and the fluid flows more or less directly along a rectilinear path between the upstream orifice 12 and the downstream orifice 16.

When waste water is caused to flow by a discharge of clean water, the lever 28 is manually actuated in the direction of the arrow in FIG. 6 against the action of the spring 30, so the membrane is no longer deformed. The lever 28 may be actuated substantially simultaneously with clean water being discharged into the pipework.

Consequently, the barrier of fluid previously retained by the membrane 20 flows directly under gravity into the downstream length of the pipework, through the outlet orifice 16.

This eliminates blocking problems that are sometimes to be encountered with traps of the prior art.

Immediately after the barrier has flowed away, the discharged clean water entrains the waste water contained in a domestic appliance connected to the upstream length until it reaches the downstream length and then passes through the device 2 directly into the downstream length 18 of the evacuation pipework.

Slightly before the end of the clean water discharge, the lever 28 is released and returned by the spring 30 towards its position in which the rod 24 deforms the membrane 20 (see FIG. 3) so that the fluid has to pass over the edge 22 of the membrane 20 in order to reach the downstream orifice 16.

This requirement means that at the end of the discharge, the membrane 20 retains a barrier-forming quantity of fluid.

It should be observed that it is possible to actuate the lever 28 automatically when clean water is caused to discharge.

Figure 7:
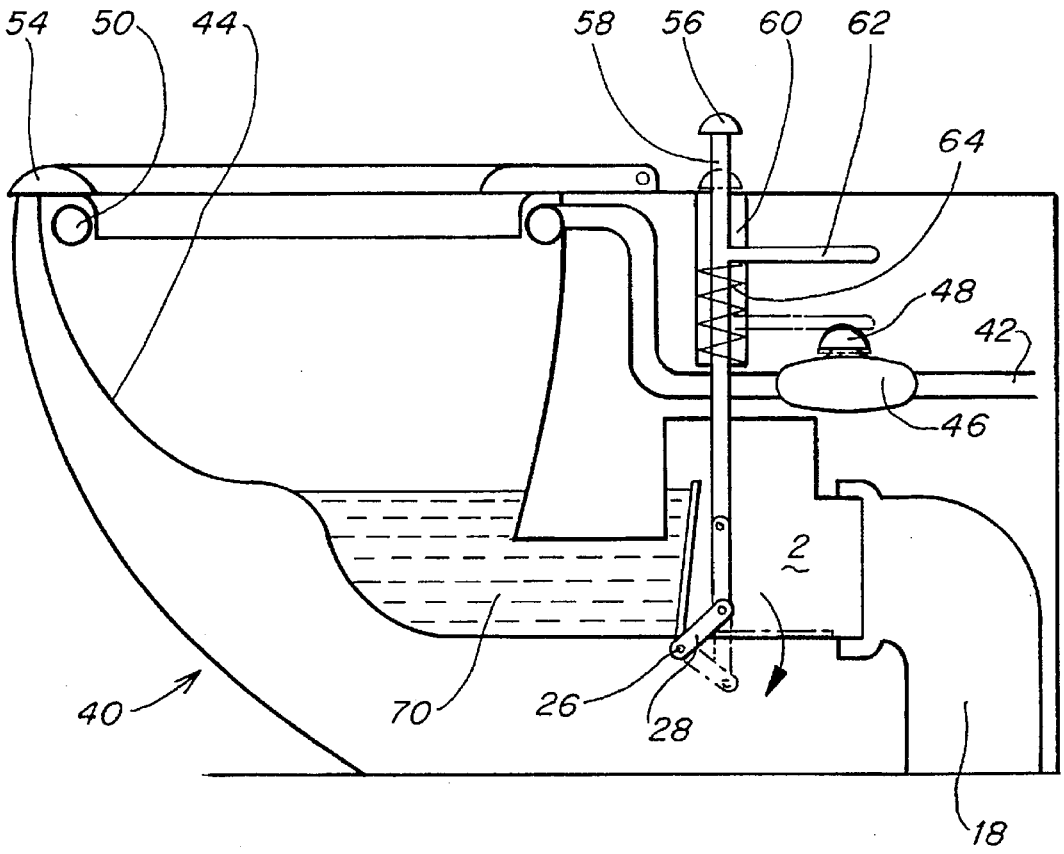
FIG. 7 is a diagrammatic section view of a toilet bowl fitted with a trap-forming device of the present invention.
Figure 8:
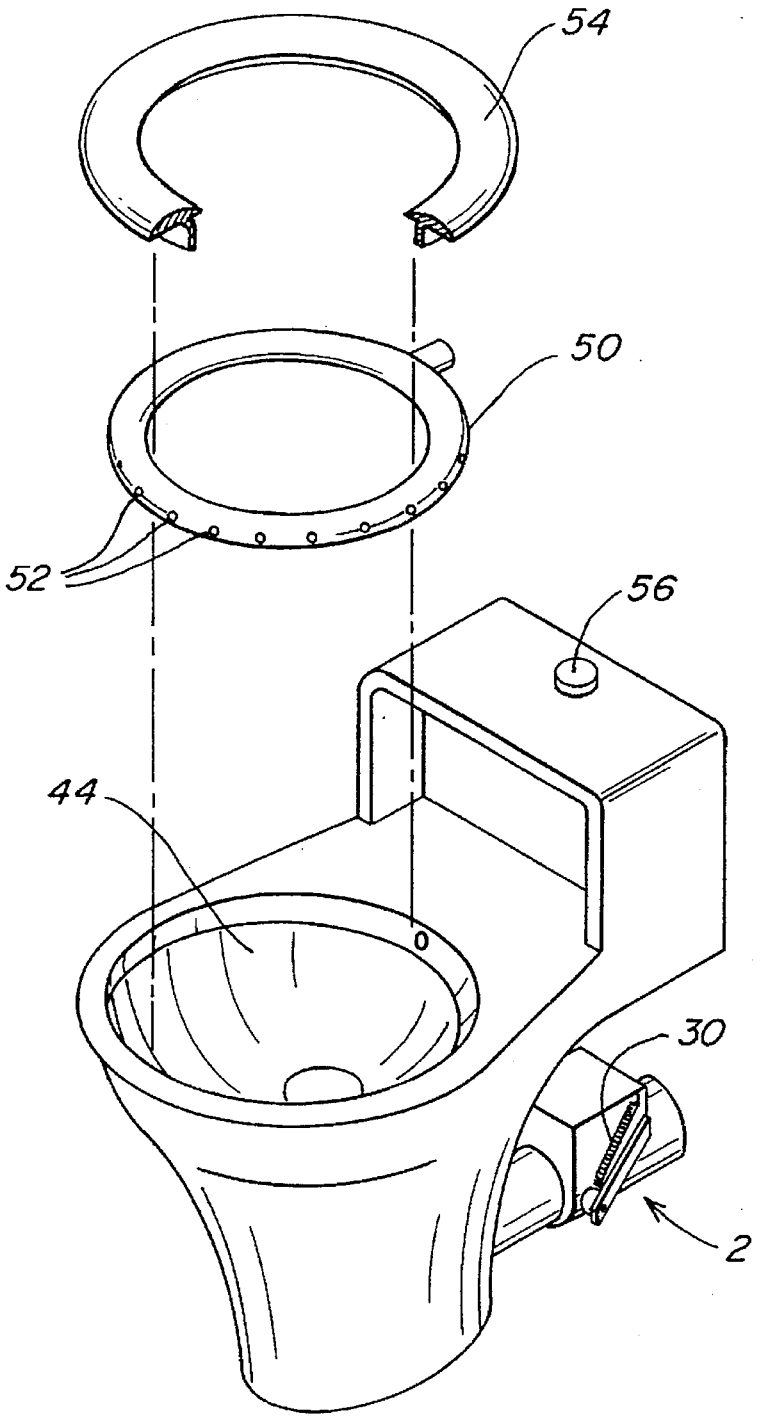
FIG. 8 is a partially exploded perspective view of the bowl shown in FIG. 7.

This possibility is particularly advantageous when the trap-forming device 2 of the invention is disposed at the outlet from a toilet bowl adapted for this purpose, as shown in FIGS. 7 and 8.

Such a toilet bowl 40 fitted with a device 2 of the invention is shown in FIG. 7. It includes an inlet 42 for water under pressure that opens out into the bowl 44 itself and that includes a timed valve 46 provided with a pushbutton 48. The inlet 42 for water under pressure preferably opens out into the toroidal ring 50 disposed in the top portion of the bowl 44 (see also FIG. 8), the toroidal ring 50 being pierced by holes 52 that are regularly spaced apart around its periphery.

An annular lip 54 protects and hides the top portion of the toroidal ring 50.

A control button 56 is disposed behind the bowl for actuating the timed valve 46.

To this end, the control knob 56 is secured to a rod 58 that is slidably mounted in a vertical tubular portion 60. A horizontal portion 62 perpendicular to the rod 58 and secured thereto projects outside the tubular portion 60, passing through a slot (not shown) provided longitudinally through the wall of the tubular portion.

The portion 62 extends over the pushbutton 48 of the timed valve 46.

A spring 64 is organized between the bottom of the tubular portion 60 and the portion 62 in such a manner as to return the portion 62 towards a position that is remote from the pushbutton 48, as shown in FIG. 7.

The rod 58 has an end projecting downwards from the bottom of the tubular portion 60, which end is mechanically connected to the lever 28 in such a manner that downward translation of the rod 58 is transformed into rotation of the lever 28 about the axis of the shaft 26.

This mechanical link may be of any type presently known in the art of transforming motion.

As shown in FIG. 8, this mechanical link may be hidden at its bottom end by the bowl, and at its top end by a box including a compartment for receiving paper or cleaning substances, for example.

When pressure is applied to the control button 56, the projecting portion 62 moves the pushbutton 48 downwards, thereby opening the timed valve 46 and thus causing clean water to be discharged out under pressure.

Simultaneously, and automatically, the lever 28 is actuated in the direction of the arrow in FIG. 7, so that the fluid barrier retaining means 70 of the device 2 of the invention is retracted (see FIG. 5) with the barrier 70 then flowing directly into the downstream length.

The spring 30, associated with the spring 64, returns the lever 28 almost immediately to its position in which the membrane 20 is deformed and constitutes means for retaining a barrier such as the barrier 70, the projecting portion 62 then moving away from the pushbutton 48, and releasing it. The button then returns towards its position for closing the valve 46. This return takes place over an interval of time that is predetermined in such a manner that a predetermined quantity of clean water has been fed through the valve 46.

This predetermined quantity of water cleans the walls of the bowl and also the membrane, however it has practically no effect in disposing of the barrier 70 which has already been disposed of, thereby making it possible to use a predetermined quantity of water which is small.

Thus, using a small quantity of clean water, a fluid barrier 70 is obtained that is clean.

Tests have shown that results are excellent when delivering quantities of clean water that are less than 3 liters.

Various modifications may be envisaged by the person skilled in the art without going beyond the field of the invention.

Thus, the toilet bowl may be a conventional flush toilet bowl with its flush control connected in appropriate manner to the lever 28, or the shape of the hollow body may be different from that described.

I claim:

1. A trap-forming device comprising:

a hollow body having an upstream orifice and a downstream orifice in a bottom portion thereof, the upstream orifice being adapted to communicate with an upstream length of fluid evacuation pipework and the downstream orifice being adapted to communicate with a downstream length of pipework, the upstream orifice having a diameter and being disposed on a wall of the body;

retaining means disposed in the body and being displaceable between an active position and a retracted position, the retaining means defining an overflow edge and cooperating with a portion of the upstream length of fluid evacuation pipework to retain a quantity of fluid that forms a fluid barrier when in the active position, the retaining means including an elastically deformable membrane that is not deformed and extends longitudinally in a flow direction when in the retracted position, the membrane having a length as measured adjacent the bottom portion of the body in the flow direction that is greater than the diameter of the upstream orifice and being U-shaped in a plane perpendicular to the flow direction, the membrane including edges at upper free ends of the U-shape that are fixed to the body, a U-shaped upstream edge that is fixed against the wall of the body, and a downstream edge that is free, the upstream orifice being positioned inside the U-shape; and controlled displacement means for controlling displacement of the retaining means, the displacement means including deformation means for deforming the membrane.

2. A trap-forming device according to claim 1, wherein the flow of fluid is approximately rectilinear between the upstream orifice and the downstream orifice when the retaining means is in the retracted position.

3. A trap-forming device according to claim 1, wherein the downstream edge is U-shaped and positioned adjacent the downstream orifice in a plane perpendicular to the flow direction when the membrane is in the retracted position, the downstream orifice being positioned facing the inside of the U-shape.

4. A trap-forming device according to claim 1, wherein the deformation means includes a rod rotatably mounted on the body and actuator means disposed outside the body for actuating the rod, the rod being mounted on a shaft that is perpendicular to the flow direction and disposed beneath the membrane adjacent the upstream orifice, the rod extending substantially in a midplane of the membrane towards the downstream orifice so as to not deform the membrane when the rod is placed in a rest position beneath the membrane.

5. A trap-forming device according to claim 4, wherein the actuator means is connected to the shaft for rotating the rod and includes a lever and return means urging the lever towards the active position of the membrane.

6. A trap-forming device according to claim 1 in combination with a toilet bowl, the toilet bowl including a bowl and manual control means for controlling the discharge of a predetermined quantity of clean water into the bowl, the manual control means being connected to the displacement means for displacing the retaining means of the trap-forming device toward the retracted position, the displacement means being actuated substantially simultaneously with actuation of the manual control means.

7. A trap-forming device in combination with a toilet bowl according to claim 6, wherein the displacement means urges the retaining means towards the retracted position before all of the predetermined quantity of clean water has been discharged into the bowl.

8. A trap-forming device in combination with a toilet bowl according to claim 6 or claim 7, wherein the toilet bowl includes a timed valve connected to inlet pipework that provides clean water under pressure into the bowl, the timed valve controlling the predetermined quantity of clean water.

* * * * *